US005235992A

United States Patent [19]

Sensabaugh, Jr.

[11] Patent Number: 5,235,992

[45] Date of Patent: Aug. 17, 1993

[54] PROCESSES FOR PRODUCING FLAVOR SUBSTANCES FROM TOBACCO AND SMOKING ARTICLES MADE THEREWITH

[75] Inventor: Andrew J. Sensabaugh, Jr., Winston-Salem, N.C.

[73] Assignee: R. J. Reynolds Tobacco Company, Winston-Salem, N.C.

[21] Appl. No.: 800,680

[22] Filed: Nov. 27, 1991

Related U.S. Application Data

[63] Continuation-in-part of Ser. No. 722,778, Jun. 28, 1991.

[51] Int. Cl.[5] ..... A24F 1/22; A24F 1/32; A24F 13/04

[52] U.S. Cl. ..... 131/194; 131/299; 131/300; 131/301; 131/297; 131/298; 131/905; 131/270

[58] Field of Search ..... 131/299, 300, 301, 302, 131/194, 199, 287, 298, 905, 270

[56] References Cited

U.S. PATENT DOCUMENTS

| | | | |
|---|---|---|---|
| 678,362 | 7/1901 | Froehling . | |
| 3,174,485 | 3/1965 | Griffith et al. | 131/17 |
| 3,316,919 | 5/1967 | Green et al. | 131/143 |
| 3,424,171 | 1/1969 | Rooker | 131/143 |
| 3,803,004 | 4/1974 | Egri | 203/29 |
| 4,079,742 | 3/1978 | Rainer et al. | 131/2 |
| 4,150,677 | 4/1979 | Osborne, Jr. et al. | 131/8 R |
| 4,590,954 | 5/1986 | Gooden | 131/301 |
| 4,708,151 | 11/1987 | Shelar | 131/359 |
| 4,714,082 | 12/1987 | Banerjee et al. | 131/359 |
| 4,732,168 | 3/1988 | Resce et al. | 131/359 |
| 4,756,318 | 7/1988 | Clearman et al. | 131/359 |
| 4,771,795 | 9/1988 | White et al. | 131/194 |
| 4,793,365 | 12/1988 | Sensabaugh, Jr. et al. | 131/194 |
| 4,827,950 | 5/1989 | Banerjee et al. | 131/335 |
| 4,881,556 | 11/1989 | Clearman et al. | 131/339 |
| 5,016,654 | 5/1991 | Bernasek et al. | 131/302 |
| 5,038,802 | 8/1991 | White et al. | 131/297 |
| 5,105,838 | 4/1992 | White et al. | 131/194 |

FOREIGN PATENT DOCUMENTS 1383029 2/1975 United Kingdom .

OTHER PUBLICATIONS

Roeraade et al., *J. Agr. Food Chem.*, 20:1035 (1972).

*Primary Examiner*—Randall L. Green
*Assistant Examiner*—Paul Prebilic
*Attorney, Agent, or Firm*—Grover M. Myers; Steven P. Shurtz

[57] ABSTRACT

Processes for producing flavor substances from tobacco are disclosed. The processes involve heating tobacco during a first staged heating to a first toasting temperature to drive off volatile materials; increasing the toasting temperature during a second staged heating to a second toasting temperature and separately collecting, as flavor substances, at least portions of the volatile materials driven off at the first and second toasting temperatures.

Another aspect of the present invention involves reducing the moisture content of the tobacco without removing volatile flavor components, such as by freeze drying the tobacco, and then heating the dried tobacco.

Preferably the tobacco is heated in a flowing gas stream and at least portions of the volatile materials are separately collected as flavor substances as the gas stream passes sequentially through a moderate temperature trap, a cold temperature trap and a filter capable of collecting submicron sized particles.

It has been discovered that better flavor release can be obtained from smoking articles that incorporate extracted tobacco flavor substances applied to a substrate if the substances are separately extracted and are then applied separately to a plurality of individual segments of the substrate. Thus one aspect of the present invention is a smoking article comprising separately extracted tobacco flavor substances applied to a plurality of individual segments of a carrier within the smoking article.

35 Claims, 2 Drawing Sheets

FIG. 1
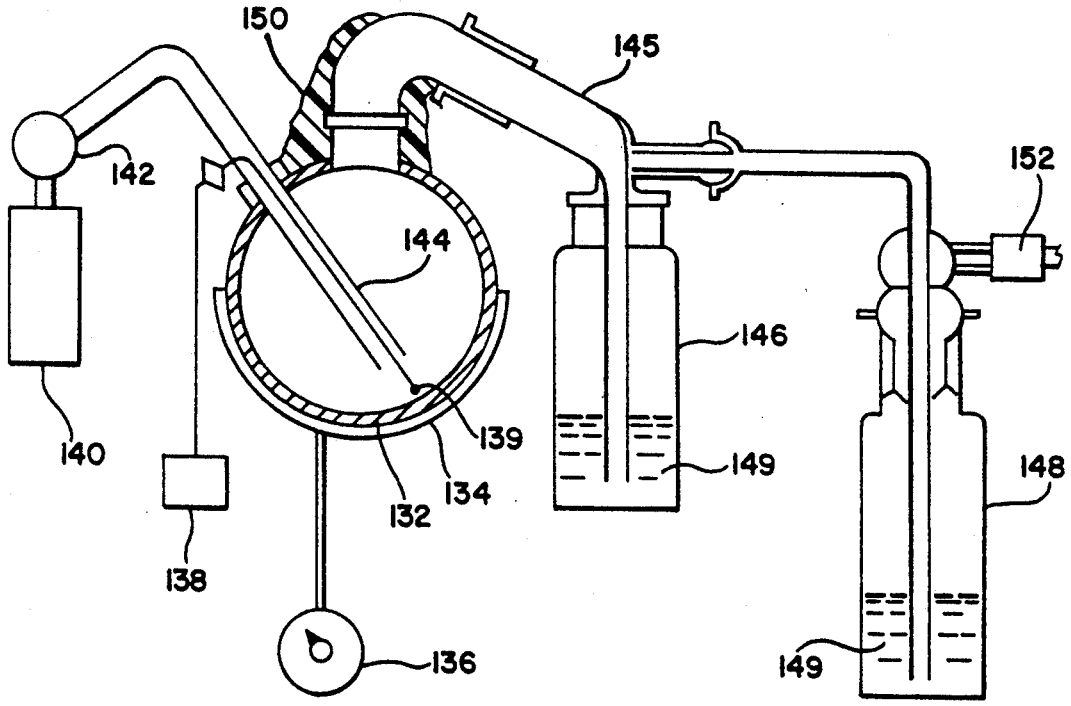
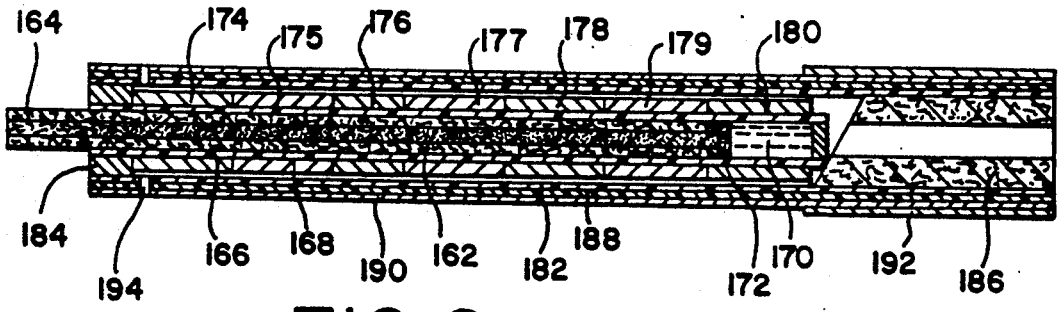
FIG. 2

PROCESSES FOR PRODUCING FLAVOR SUBSTANCES FROM TOBACCO AND SMOKING ARTICLES MADE THEREWITH

CROSS REFERENCE TO RELATED APPLICATION

This application is a continuation in-part of Application Ser. No. 07/722,778, filed Jun. 28, 1991, entitled "Tobacco Smoking Article with Electrochemical Heat Source," the disclosure of which is hereby incorporated by reference.

BACKGROUND OF THE INVENTION

The present invention relates to cigarettes and other smoking articles such as cigars, pipes and the like. In particular, the invention relates to processes for extracting flavor substances from tobacco; and to smoking articles made, at least in part, with extracted tobacco flavor substances.

Cigarettes, cigars and pipes are the most popular forms of tobacco smoking articles. Many smoking products and improved smoking articles have been proposed through the years as improvements upon, or as alternatives to, these popular forms of tobacco smoking articles. Examples of improved smoking articles are the cigarettes and pipes described in U.S. Pat. Nos. 4,756,318; 4,714,082 and 4,708,151, which generally comprise a fuel element, a physically separate aerosol generating means, and a separate mouthend piece.

Tobacco substitute smoking materials have likewise been proposed as improvements upon and/or as alternatives to tobacco. See, e.g., U.S. Pat. No. 4,079,742 to Rainer et al.

Generally, natural tobacco flavors are important for the taste, aroma and acceptance of smoking products, including substitute smoking materials. Thus, the search for natural tobacco flavor additives (or flavor substances) is a continuing task.

For instance, U.S. Pat. No. 3,424,171 describes a process for the production of a non-tobacco smokable product having a tobacco taste. Tobacco is subjected to a moderate (i.e., below scorching) heat treatment, i e., at from about 175° to 200° C. (or about 350°–400° F.), to drive off aromatic components. These components are trapped on adsorbent charcoal, and removed from the charcoal by solvent extraction. The smokable product disclosed is vegetable matter, treated with the mixture of tobacco aromatic components and the solvent.

Similarly, U.S. Pat. No. 4,150,677 describes a process for the treatment of tobacco which comprises the steps of: (1) contacting tobacco which contains relatively high quantities of desirable flavorants with a stream of non-reactive gas, under conditions whereby the tobacco is heated in a temperature range from about 140° to about 180° C.; (2) condensing the volatile constituents of the resulting gaseous stream; and (3) collecting said condensate. The condensate may be used subsequently to flavor a smoking material in order to enhance the organoleptic properties of its smoke.

British Patent No. 1,383,029 describes a method for obtaining tobacco aroma substances which comprises an extraction treatment wherein the components of the tobacco that are soluble in a suitable solvent are extracted and the residue obtained after removing the solvent is subjected to heat treatment at a temperature from 30° to 260° C.

Similarly, U.S. Pat. No. 3,316,919 describes a process for improving the taste of smoking tobacco that entails adding a powder of freeze dried aqueous tobacco extract to tobacco cut filler in amounts ranging from about 5 to 10% by weight.

U.S. Pat. Nos. 5,038,802 to White et al. and 5,016,654 to Bernasek et al. disclose extraction processes which heat tobacco and then pass an inert atmosphere through the heating chamber to collect volatiles from the tobacco. The volatiles are then fractionated in downstream operations, which include liquid sorbents, cold temperature traps and filters.

While these processes have produced flavor substances acceptable for use in many smoking articles, they have either not been suitable for some smoking articles, such as those that use a heat source that generates a low temperature in the substrate to which they are applied, or they have not been applied to such substrates in a fashion that permits an optimum release therefrom. Thus, it would be desirable to provide processes for producing better flavor substances from tobacco and smoking articles which utilize extracted tobacco flavors in a manner so as to obtain an optimum release of the flavor substances from the smoking article.

SUMMARY OF THE INVENTION

It has now been discovered that better flavor release can be obtained from smoking articles that incorporate extracted tobacco flavor substances applied to a substrate if the substances are separately extracted and are then applied separately to a plurality of individual segments of the substrate. Thus one aspect of the present invention is a smoking article comprising separately extracted tobacco flavor substances applied to a plurality of individual segments of a carrier within the smoking article.

Improved processes for producing flavor substances from tobacco have also been discovered. Thus another aspect of the present invention involves heating tobacco during a first staged heating to a first toasting temperature to drive off volatile materials; increasing the toasting temperature during a second staged heating to a second toasting temperature and separately collecting, as flavor substances, at least portions of the volatile materials driven off at the first and second toasting temperatures.

Another aspect of the present invention involves reducing the moisture content of the tobacco without removing volatile flavor components, such as by freeze drying the tobacco, and then heating the dried tobacco at a toasting temperature to drive off volatile materials, at least a portion of which are then collected.

In another aspect of the present invention, tobacco is heated in a flowing gas stream at a toasting temperature to drive off volatile materials, and at least portions of the volatile materials are separately collected as flavor substances as the gas stream passes sequentially through a moderate temperature trap, a cold temperature trap and a filter capable of collecting submicron sized particles.

Flavor substances produced by these various processes of the invention have been found to provide better flavor than previously known extracted flavor substances when employed in tobacco smoking articles, particularly those in which the carrier to which they are applied is heated to a low temperature, such as between about 80° C. and about 200° C. Also, it has been found that when separately extracted flavor substances are applied to individual segments of a carrier in a smoking article, the substances are released in a more optimum fashion, developing a more desirable flavor.

These and other advantages of the present invention, as well as the invention itself, will be best understood in view of the accompanying drawings and detailed description of the invention which follows.

BRIEF DESCRIPTION OF THE DRAWINGS

FIG. 1 is a schematic representation of a system for extracting and separately collecting tobacco flavors useful in practicing the present invention;

FIG. 2 is a longitudinal, sectional view of a preferred embodiment of a cigarette of the present invention showing a heat source partially inserted into a heat chamber in a heat exchange relationship with a segmented substrate to which tobacco extracts have been applied.

DETAILED DESCRIPTION OF THE PREFERRED EMBODIMENTS

Figure 3:
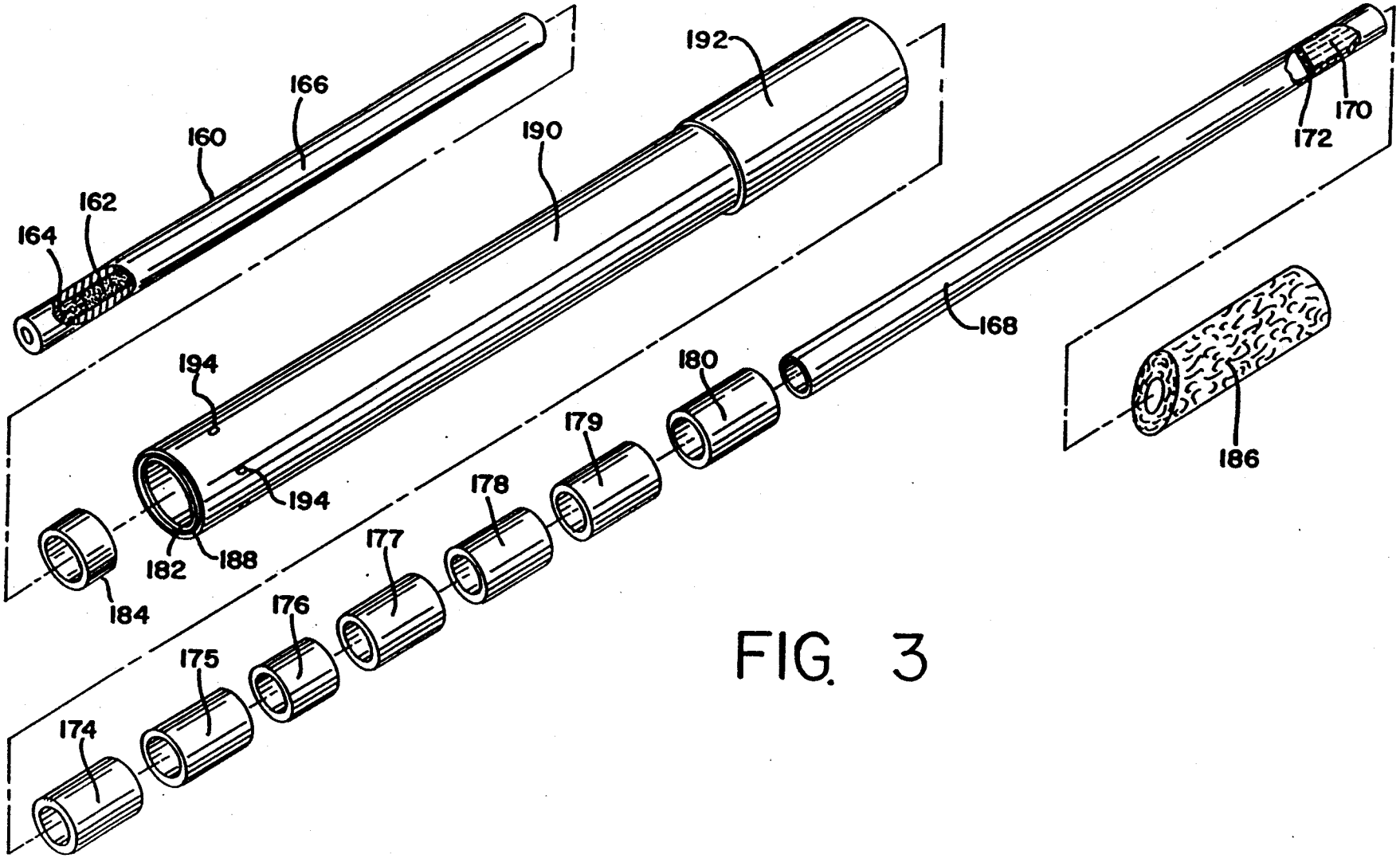
FIG. 3 is a prospective, exploded view of the cigarette of FIG. 2.

The tobacco smoke flavor substances of the present invention are derived by the "toasting" of natural tobacco, e.g., Burley, Flue Cured, Turkish, Latakia, Md., etc. types of tobacco, or blends thereof. In preferred embodiments, the types of tobacco are extracted separately, though some types may be blended together, such as Flue Cured and Turkish.

As used herein, the term "toasting" refers to the process of heating tobacco in a suitable container, preferably under an inert atmosphere, within a temperature range sufficiently high to drive-off volatiles, without excessively charring or burning the tobacco. Generally, this temperature range has been found to be between about 100° C. and about 350° C. at atmospheric pressure.

There are several unique aspects of the present invention which relate to processes for producing flavor substances from tobacco. Briefly, they are (1) using a multi-staged heating operation and separately collected flavoring substances during each stage, (2) reducing the moisture content of the tobacco, without removing volatile flavor components, prior to heating the tobacco to extract the flavor components and (3) separately collecting, as flavor substances, at least portions of volatile materials produced when tobacco is toasted in a flowing gas stream by passing the gas stream sequentially through a moderate temperature trap, a cold temperature trap and a filter capable of collecting submicron sized particles. Each of these aspects may be used independently or in combination of any two aspects, but in the preferred embodiment of the invention they are used together.

FIG. 1 depicts an apparatus that may be used to practice the processes of the present invention. The apparatus of FIG. 1 depicts laboratory scale equipment. It is understood that other equipment could be used, and that the process could be scaled up to use larger sized equipment for commercial applications. The apparatus of FIG. 1 includes a round bottom flask 132 with a heating mantle 134 controlled by a powerstat 136. A thermocouple 139 and temperature recorder 138 monitor and record the temperature in the flask 132. Nitrogen or another inert carrier gas is supplied from a tank 140 equipped with a flow meter 142. The nitrogen enters the flask 132 through a glass tube 144 and exits through a side arm adapter 145. Fiberglass insulation 150 insulates the outlet to the round bottom flask 132. The collection system includes two collection flasks (146 and 148) with exit tubes, each containing a liquid sorbent 149, such as propylene glycol, in the bottom of each flask. The carrier gas, containing the extracted flavors, is bubbled sequentially through the sorbent 149 in each flask. Flask 146 is a moderate temperature trap. Flask 148 is cooled and acts as a cold temperature trap. A filter 152 on the exit tube of collection flask 148 traps any uncollected extracts.

In the process of the present invention, the tobacco used for the extraction will preferably first have its moisture content reduced without removing volatile flavor components. It is believed that moisture in the tobacco negatively interacts with flavor components during the extraction process. Preferably the moisture content will be reduced to less than about 4%, and more preferably to less than about 1%. (All percentage herein are weight percents unless otherwise specified.)

The preferred water reduction method is freeze drying the tobacco. Freeze drying the tobacco will generally be at a pressure below about 100 millitorr and at a temperature less than about 0° C. Most preferably the freeze drying will be carried at less than about 10 millitorr and less than about −5° C. Another contemplated method of reducing the tobacco moisture content is the use of a strong desiccant, such as calcium sulfate. Using this method, a sufficient amount of the desiccant and the tobacco are placed in a tightly closed container for a sufficient time period for the moisture in the tobacco to be drawn from the tobacco to the desired degree of dryness.

In a preferred embodiment, the tobacco is toasted at atmospheric pressure, but higher or lower pressures may be used. When the toasting is conducted at lower pressures, lower temperatures are effective for driving off the desired volatile materials. Those having ordinary skill in the art to which this invention pertains, with benefit of the present disclosure, will readily be able to determine appropriate temperatures for subatmospheric and superatmospheric pressures.

In the preferred process, the tobacco is heated to at least two different toasting temperatures, preferably in a staged manner, with the volatiles released at each temperature being separately collected. With a two-staged heating, the difference between the first and second toasting temperatures will preferably differ by at least about 50° C. When atmospheric pressures are used for a two-staged heating, the first toasting temperature will preferably be between about 100° C. and about 225° C., and the second toasting temperature will preferably be between about 225° C. and about 350° C. More preferably the first toasting temperature will be between about 200° C. and about 216° C. and the second toasting temperature will be between about 270° C. and about 325° C. Optimum temperatures will vary depending on the tobacco used.

Preferably the carrier gas flow is initiated early in the heating process, possibly as soon as heating begins. This way volatiles are removed from the heating chamber, cooled and collected as soon as they are released. It is believed that this prevents undesirable reactions that might otherwise occur between flavor substances and other tobacco components at elevated temperatures. An important part of this aspect of the invention is separately collecting the flavor substances given off at the different stages of heating. Thus the collection flasks are preferably changed when heating to the second toasting temperature is initiated. The time at which the tobacco is held at each stage may vary, depending on the tobacco, temperature, carrier gas flow rates and flavor desired. One way to judge whether collection at a given temperature will produce additional flavor substances is to view whether aerosols are still exiting the second flask 148. When no further substances are being collected at the first toasting temperature, the collection flasks should be changed and the tobacco heated to the higher second toasting temperature.

Preferably the heating is carried out slowly so that portions of the tobacco closer to the heat source are not heated to a temperature much higher than the tobacco furthest from the heat source. Since the tobacco acts as an insulator, if the heating is performed too quickly, the tobacco next to the wall of flask 132 can char before the tobacco in the center is heated. More rapid heating may be possible if the tobacco is agitated or other more uniform heat transfer methods are utilized. Preferably none of the tobacco will be heated to a temperature of more than about 20° C. above the temperature of other tobacco in the flask 132. This also assures that none of the tobacco reaches a temperature of more than about 20° C. above the first toasting temperature during the first staged heating and about 20° C. above the second toasting temperature during the second staged heating. Thus all of the flavor substances collected in the separate collections will be from tobacco heated to the same general temperature range.

Preferably the flavor substances will be separately collected by passing the flowing gas stream sequentially through 1) a moderate temperature trap, 2) a cold temperature trap, and 3) a filter capable of collecting submicron sized aerosol particles. In the preferred embodiments, either one, or most preferably both, of the moderate and cold temperature traps comprise a sorbent through which the gas stream passes. Suitable sorbents are known and available to the skilled artisan, and include solids such as carbon (activated or unactivated), alumina, alpha alumina, tobacco, diatomaceous earth, clays and the like. Suitable liquid sorbents include those materials typically used in the manufacture of cigarettes, including humectants, such as glycerin and propylene glycol. Other liquid sorbent media useful herein include triacetin, vegetable oils, e.g., sunflower, corn, peanut, etc. Especially preferred solid sorbent media are sintered alpha alumina and activated carbon. An especially preferred liquid sorbent medium is propylene glycol. Liquid sorbents have the advantage that the flavor compositions can be easily applied to a substrate used in the smoking article while still dissolved in the sorbents. With solid sorbents, the flavor substances may be extracted with a liquid solvent that is then applied to a substrate, or the solid sorbents with the flavor substance thereon may be incorporated into the substrate, or otherwise incorporated into the smoking article.

When the process is carried out at atmospheric pressure, the moderate temperature trap will preferably cool the gas stream to a temperature below about 50° C., and most preferably to a temperature of between about 20° C. and about 40° C., and the cold temperature trap will cool the gas stream to a temperature below about 10° C., and most preferably to a temperature between about 5° C. and about 0° C. Suitable moderate temperature traps can thus be held at room temperature and suitable cold temperature traps can be operated at about 0° C. by using an ice bath.

A suitable filter 152 will remove submicron sized aerosol particles that are not removed by the traps 146 and 148. A Cambridge filter has been used satisfactorily. Under atmospheric pressure operating conditions, the filter 152 will preferably be maintained at a temperature below about 40° C., and can be operated at room temperature. The flavor substance collected on the filter may be eluded with any suitable solvent, such as propylene glycol.

The inert gas used as the carrier gas may be any gas which does not have a detrimental effect on the gaseous products evolved from the heated tobacco. Such gases include nitrogen, argon and the like. The inert atmosphere is employed as a carrier gas, at a sufficient sweep velocity to force the volatile components from flask 132, through the moderate and cold temperature traps 146 and 148 and filter 152.

In the following examples, extractions were carried out generally using the apparatus depicted in FIG. 1. The flask 132 was a 250 ml round bottom flask. Nitrogen was supplied at a rate of 1 liter/minute from tank 140. Each collection flask 146 and 148 was a 125 ml flask. Flask 146 was maintained at room temperature, and flask 148 was maintained at an ice bath temperature. The filter 152 was used for Examples 5, 6 and 7. Other differences in the extraction apparatus, if they existed, are noted in the description of the examples.

EXAMPLE 1

A sample of Flue Cured tobacco that had been freeze dried to remove moisture was distilled using the apparatus of FIG. I except that instead of a filter 152, the outlet of flask 148 was connected to a trap cooled by dry ice and containing glass beads. Flasks 146 and 148 both included 15 g of propylene glycol and a frit placed on the end of the inlet tubes. The powerstat 136 was set up to operate the heating mantel 134 at 250° C. However, when heat was applied, it was obvious that the bottom of the flask 132 was getting too hot. The current to the heating mantel 134 was limited to keep the temperature in the flask 132 at 260° C. The system was operated at 260° C. for 1½hours, at which time the frit in flask 146 stopped up and had to be cleaned out. After the frit was cleaned out the system operated another 30 minutes before it stopped up. A fine aerosol was noticed escaping from the dry ice trap and the dry ice trap did not increase in weight. The materials in flasks 146 and 148 were separately collected and labeled (respectively Samples 1-1 and 1-2).

EXAMPLE 2

A sample of freeze dried Burley tobacco was distilled in the apparatus of FIG. 1 except that no ice-bath temperature trap (flask 148) or filter 152 were used. Flask 146 contained 20 g of propylene glycol. The voltage to the heating mantle 134 was increased over a 2 hour period until 216° C. was obtained. This temperature was continue for 3 hours and the material from flask 146 was collected (Sample 2-1), though the distillation of Burley tobacco did not give much color to the propylene glycol at this temperature. The effluent from the exit of flask 146 had a nicotine—$NH_3$ aroma and was basic to pH paper. The system was shut off, flask 132 was stoppered and allowed to cool over night. The next day 20 g of fresh propylene glycol was placed in flask 146 and the heating mantel 134 turned on. The second heating stage took about 2.5 hours to reach a temperature of 325° C., and distillation was continued for 3 hours thereafter. The material from flask 146 was again collected (Sample 2-2). It had a golden color and an earthy, nicotine-end aroma.

EXAMPLE 3

A sample of freeze dried Flue Cured tobacco was distilled using the apparatus of FIG. 1 modified as described in Example 1, except that a frit was only used in flask 148 and 20 g of propylene glycol were used in flask 146. The temperature was raised in a first stage heating over a period of 2 hours to 216° C. and remained at this temperature for about 4 hours. Approximately 1.5 hours after the 216° C. temperature was reached the frit in flask 148 had enough back pressure to cause the system to leak, requiring the frit to be cleaned up so that the run could be completed.

Samples were taken from the traps. The room temperature trap (flask 146) had a weight gain of 2.42 g (Sample 3-1). The ice-bath trap (flask 148) had a weight gain of 1.23 g (Sample 3-2). The dry ice trap had only a 20 mg weight gain. At this temperature very little aroma escaped the dry ice trap exit. Sample 3-1 was amber colored and had a Flue Cured-like aroma. Sample 3-2 was light yellow and had a green hay-grass note. Equal parts of Samples 2-1, 2.2, 3-1 and 3-2 were mixed together to use as a combination flavor (Sample 3-C).

EXAMPLE 4

Forty-five grams of freeze-dried Flue Cured tobacco was heat treated in the round bottom flask 132 as shown in FIG. 1, with 20 g of propylene glycol in each flask 146 and 148. The freeze drying was at 5–10 millitorr overnight at −8° C., reducing the moisture content to less than 1%. Heat was applied to the flask 132 in a staged manner that reached −~212° C. in 2-3/5 hours. After approximately five hours at this temperature, samples were pulled from collection flasks 146 and 148 and labeled (Samples 4-1 and 4-2). Another 20 g of propylene glycol was then put into each collection flask. The temperature was then increased to ~270° C. in ½ hours. Samples were then again removed from flasks 146 and 148 (Samples 4-3 and 4-4). Ten grams of each Sample 4-1, 4-2, 4-3 and 4-4 were mixed to yield 40 grams of Flue Cured flavor (Sample 4-C).

Forty-five grams of freeze-dried Turkish tobacco was placed in the flask 134 and processed in the same manner as Example 4, except a double Cambridge filter was placed at the exit 152 of flask 148. In previous experiments, aerosol was observed at this exit. The Cambridge filter pads entrapped this material. The temperature increase at the thermocouple was staged to reach 216° C.±2° over 4.5 hours and held for 4 hours. The propylene glycol was removed from flasks 146 and 148 (Samples 5-1 and 5-2) and the temperature was increased. Fresh propylene glycol was added to clean collection flasks and the temperature was increased to 275° C.±5° in 1.25 hours. The Cambridge filter pads from the filters were extracted with 15 g propylene glycol (Sample 5-3) at the same time as the fresh propylene glycol was added to flasks 146 and 148. Approximately 0.75 g of material was collected on the pads. The 275° C. temperature was maintained for −3.5 hours. At this time the propylene glycol from flasks 146 and 148 was again collected (Samples 5-4 and 5-5). Only 20 mg of material was collected on the Cambridge pads for the second phase of the run, which was probably due to a build up of solid material between flask 146 and flask 148. This solid material was washed into flask 148 (Sample 5-5). Ten grams each of Samples 5-1, 5-2, 5-4 and 5.5, and 5 grams of Sample 5-3 were combined to yield 45 grams of combined Turkish flavor (Sample 5-C).

EXAMPLE 6

Forty-five grams of freeze dried Latakia tobacco were placed in the distillation system shown in FIG. 1 with 20 g of propylene glycol in each of flasks 146 and 148. The system was heated to 200° C. in ~4.5 hours and remained above 200° C. for −3.5 hours. A large amount of oil-like material collected in the flask 146. The propylene glycol was therefore changed in the middle of the low temperature run. At the end of the 3.5 hours, samples were collected from both flasks 146 and 148, and the temperature was slowly increased over a period of about ~1.0 hour to 270–275° C. Flask 132 then remained at this temperature for 3 hours and 45 minutes. Again, the propylene glycol in flask 146 was changed in the middle of the high temperature run. A Cambridge filter was initially placed on the exit of flask 148 and replaced at the end of the low temperature heating. Material was eluted from the Cambridge filter (0.78 g) that collected during low temperature heating with about 7.0 g propylene glycol. The filter used during the high temperature heating was also eluted with about 7.0 g propylene glycol. The following samples were thus collected in this extraction run.

| Sample | Trap Description | Retort Temperature & Time |
|---|---|---|
| 6-1 | Flask 146 | Initial heating and 210° C. for 2 hours |
| 6-2 | Flask 146 | 210° C. between hours 2 and 4 |
| 6-3 | Flask 148 | Initial heating and 210° C. for ~4 hours |
| 6-4 | Cambridge Filter | Initial heating and 210° C. for ~4 hours |
| 6-5 | Flask 146 | Second stage heating and 275° C. for ~2 hours |
| 6-6 | Flask 146 | 275° C. between hours 2 and 3.5 |
| 6-7 | Flask 148 | Second stage heating and 275° C. for ~3.5 hours |
| 6-8 | Cambridge Filter | Second stage heating and 275° C. for ~3.5 hours |

A combination flavor (Sample 6-C) was made from 10 grams each of Samples 6-1, 6-3, 6.5 and 6-7 and 1 gram each of Samples 6-4 and 6-8.

EXAMPLE 7

Forty-five grams of freeze-dried Burley tobacco was distilled using the apparatus of FIG. 1 with 20 g of propylene glycol in each of flasks 146 and 148. A Cambridge filter was used on the exit of flask 148. The system was staged to about 250° C. over a 3.5 hour period and continued at that temperature for about 3.5 hours. Samples were collected from the flasks 146 Sample 7-1) and 148 (Sample 7-2) and eluted from the Cambridge pad (Sample 7-3). The flask 132 was cooled and sealed for storage over the weekend. The flask 132 was thereafter put back into the distillation system of FIG. 1 with 20 g of fresh propylene glycol in each flask 146 and 148 and the system was staged to about 320° C. over a 3.5 hour period. The distillation was continued at this temperature for about 3.5 hours. Samples were again collected from the flasks 146 Sample 7-4) and 148 (Sample 7-5) and eluted from the Cambridge pad (Sample 7-6). A combination flavor (Sample 7-C) was made by mixing 10 grams each of Samples 7-1, 7.2, 7.4 and 7-5 and 1 gram each of Samples 7.3 and 7-6.

The flavor substances of the present invention are particularly advantageous because they are capable of providing a good tobacco smoke taste to cigarettes and other smoking articles. The flavor substances of the present invention may be used in a variety of ways. For example, they may be added to conventional cigarettes or other smoking articles as a top dressing or in any other convenient mode selected by the manufacturer.

The preferred smoking article of the present invention is one that is capable of providing the user with pleasures of smoking (e.g., smoking taste, feel, satisfaction, and the like), without burning tobacco or any other material, without producing sidestream smoke or odor, and without producing combustion products such as carbon monoxide. Preferably, the smoking articles which employ the improved flavor substance of the present invention are cigarettes which utilize a non-combustion heat source, such as an electrochemical, chemical or electrical heat source. The following U.S. Patents describe smoking articles with such heat sources: U.S. Pat. No. 4,938,236 to Banerjee et al., U.S. Pat. No. 4,955,399 to Potter et al. and U.S. Pat. No. 4,947,874 to Brooks et al., the disclosures of which are hereby incorporated by reference.

Another particular type of cigarette in which the flavor substances may be used includes a combustion heat source, but does not necessarily burn tobacco. Smoking articles of this type often include an aerosol generating means which is longitudinally disposed behind a fuel element and a heat conductive container which receives heat from the burning fuel element. Examples of such smoking articles are disclosed in U.S. Pat. Nos. 4,756,318; 4,714,082 and 4,708,151, and U.S. Application Ser. No. 07/723,350, filed Jun. 28, 1991, the disclosures of which are hereby incorporated by reference.

The mouthend piece of cigarettes of either the non-combustion or combustion type heat source embodiments preferably comprises a filter segment, preferably one of relatively low efficiency, so as to avoid interfering with delivery of the flavor substance or the aerosol produced by the aerosol generating means where used.

The flavor substances of the present invention may be added to various elements within the smoking article, such as tobacco, a substrate in a heat exchange relationship with a heat source, an aerosol generating means, and/or the mouthpiece end component, or any other place that it will contribute smoke flavors as the smoking article is used. Preferably, the flavor substances are added to a relatively cool region of the article, i.e., away from the heat source, e.g., in the mouthend piece. Alternatively, the heat source will preferably heat the region to which the flavor substances have been applied to a relatively low temperature.

Another important discovery associated with the present invention is that the release of smoke flavors from a smoking article to which they have been applied is dependant on how those flavors are applied. As more fully described hereafter, it was discovered that when the flavors from two or more types of tobaccos were mixed, applied to a substrate (in this case a reconstituted tobacco sheet) and the tobacco sheet heated, the flavors were not released very well. However, when the mixture of samples from the same tobacco (such as Sample 5-C) were applied to a reconstituted tobacco sheet, the flavor released much better. This was found to be true even if several different tobacco sheets carrying sample mixtures from different tobaccos were used in segments in the same cigarette. Not wishing to be bound by theory, it is contemplated that in a mixture of flavors from different tobaccos, the vapor pressure of the various flavors are reduced, preventing the flavors from releasing as well as when they are present by themselves. Also, it is believed that there may be acid-base reactions when flavor substances from two different types of tobacco are mixed.

As such, flavor substances extracted by processes of the present invention are preferably located on separate segments of a carrier, such as sheets of reconstructed tobacco. They may also be placed separately on a carrier in the cigarette and the filter element of the mouthpiece end of the cigarette.

The discovery that separately collected flavor substances may have better release characteristics when used on separate segments or areas within a smoking article has application to flavor substances in addition to those produced by the processes of the present invention. Hence, flavor substances produced or extracted in other ways may preferably be used by applying separately extracted tobacco flavor substances to a plurality of individual segments of a carrier within a smoking article. Preferably, the carrier will comprise three or more segments so that several flavor substances can be utilized in the same smoking article. This discovery and the evaluation of the flavor substances will be more easily understood in view of the preferred embodiment of a smoking article.

The presently preferred embodiment of a cigarette of the present invention is shown in FIGS. 2 and 3 and was constructed as follows. FIG. 2 is a view showing an electrochemical heat source partially inserted into a heat chamber in heat transfer relationship with segments of tobacco sheet carrying the flavor substances; and FIG. 3 is an exploded view showing the separate components of the cigarette.

The heat source 160 consists of a 6.0 cm length of extruded rod 162 having a diameter of 0.125 inches and a weight of about 0.37 g, made in accordance with Example 6 of Application Ser. No. 07/722,778. The heat source 160 is placed end to end with a cellulose fiber rod 164 (EF203032/82 available from Baumgartner, Lausanne-Crissier, Switzerland) 4.40 mm in diameter and 8.00 mm in length and held in place by wrapping the arrangement in an outerwrap 166 made of a two-ply segment of a Kleenex facial tissue 60×75 mm. The outer edge of the tissue is very lightly glued.

A mylar tube (J. L. Clark Manufacturing Co., Md.) 0.208" in diameter and 3.4" in length with one end sealed with heat serves as the heat or reaction chamber 168 where an exothermic electrochemical reaction takes place. This heat chamber 168 should be inspected after heat sealing to assure that the bottom portion did not shrink, which would interfere with its capacity and further assembly. This tube contains 0.45 ml of electrolyte solution 170, containing 20% sodium chloride, 10% calcium nitrate, 5% glycerine and 2% malic acid, sealed in the bottom behind a grease seal 172. The grease seal 172 is applied using a syringe loaded with grease. A first layer about 0.01 inches thick is applied just above the liquid level in the tube 168. A second layer of the same thickness is applied about 6 mm above the liquid.

Reconstituted tobacco sheets (P2831- 189-AA - 6215, Kimberly-Clark Corporation, Ga.) consisting of 20.7% precipitated calcium carbonate, 20% wood pulp and 59.3% tobacco are cut into 60×70 mm segments and rolled into a 7 cm tube with an internal diameter of 0.208". Various flavoring materials and humectants are applied to the rod and equilibrated overnight. Levulinic or other acids are applied to similar tobacco rods made with reconstituted sheets not containing calcium carbonate. The flavored tobacco tubes are cut into either 7 or 10 mm segments. Various segments from different tubes may then be used as segments 174–180 in the cigarette of the preferred embodiment. The segments 174–180 are placed on mylar tube 168 containing the electrolyte 170. It is important to note that the delivery of taste and flavor depends on, besides many other factors, the sequence in which the segments 174–180 are placed.

The heat chamber 168 and the flavored tobacco segments 174–180 are inserted into another mylar tube 182, 100 mm long and 0.298" O.D. A collar 184 is fabricated from reconstituted tobacco sheet (P831-189-AA5116, Kimberly-Clark corporation, Ga.) by rolling a segment of 20.5×6 cm to form a tube with a 0.293" O.D., 0.208" I.D. and 6.0 cm length. This tube is cut into 5 mm collars. The collar 184 is held in place in the end of tube 182 with Elmer's glue.

The collar 184 at the end of the outer tube 182 serves to hold the heat chamber 168 in place. To the mouth end of the tube 182 is inserted a segment of COD filter 186, one end of which is cut at a 60 degree angle. The COD filter 186 is 13 mm long on the short side and has a passage hole 4.5 mm in diameter through the center.

The outer tube 182 is wrapped with a 0.006" thick polystyrene insulating material 188 (Astro Valcour Inc., N.Y.) 49×100 mm in dimension forming several layers, only one of which is shown. This is then overwrapped with cigarette paper 190 and tipping paper 192 (respectively P2831-77 and AR5704 from Kimberly-Clark Corporation, Ga.). The initiating end of the cigarette has a series of five air intake holes 194, equally spaced 72 degrees apart and 7 mm from the end, made with a 23 gauge B-D syringe needle. The collar 184 seals the front of the cigarette so that air that flows past the tobacco segments 174–180 may only enter through holes 194. The small amount of steam or other gases created by the reaction in the heat chamber 168 pass out the initiating end of the cigarette and are thus diverted away from the air intake holes 194.

The cigarette is activated by inserting the heat source 160 through collar 184 and into the heat chamber 168, forcing electrolyte 170 to flow along outerwrap 166 and into the extruded rod 162. When fully inserted, the end of heat source 160 will be flush with the end of the heat chamber 16B and collar 184. About 30 seconds after initiation, taste and flavor components are delivered to the mouth of the smoker upon puffing. If it is desired that the cigarette generate an aroma when activated, a drop of tobacco flavor extract may be added to the fiber rod 164 or end of heat source 160. Under normal puffing conditions the cigarette will deliver the flavor and taste components for at least 7 minutes. After this period the rate of delivery decreases.

The evaluation of many of the flavor substances collected in Examples 1–7 was carried out using a model with a heat source as shown in FIG. 2, although the first evaluation used complete tubes of reconstituted tobacco sheets rather than segments of separate tubes.

EXAMPLE 8

The following blended flavor (Sample 8-B) was mixed:

| Sample | Description | Amount | % of Total |
|---|---|---|---|
| 4-C | Flue Cured | 1.00 g | 50 |
| 5-C | Turkish | 0.30 g | 15 |
| 6-C | Latakia | 0.20 g | 10 |
| 7-C | Burley | 0.50 g | 25 |

The above flavor Sample 8-B was streaked onto tubes of reconstituted tobacco sheet containing calcium carbonate at 100 mg/tube and 50 mg/tube levels. The streaked tubes were constructed into evaluation models made with a COD type filter, a heat source 160 in a mylar tube 168 inside of the tube of streaked reconstituted tobacco sheet. A filter two was used to limit the air flow rate through the model.

| Model | | Model Evaluation |
|---|---|---|
| A | 100 mg | This model had tobacco/tobacco smoke-aroma and tastes. It had sweetness and bitterness. Oily mouth feel. |
| B | 50 mg | This model had more tobacco/tobacco smoke-like taste and did not have as much sweetness; the bitter aftertaste was very similar to 100 mg model. Slight mouth coating but much less than A. |

EXAMPLE 9

Four models were made using 100 mg of flavor from each of the combination flavors independently: Flue Cured (Sample 4-C), Burley (Sample 7-C), Latakia (Sample 6-C) and Turkish (Sample 5-C). The models were made in the configuration of Example 8.

| Model | | Flavor Sample | Evaluation |
|---|---|---|---|
| A | Flue Cured | 4-C | Bitter, slightly sour tobacco, fresh mown taste, some mouth coating, strong bitter aftertaste |
| B | Burley | 7-C | Bitter, dusty, earthy, ammoniacal-like taste with some burley-like aroma. Strong bitter aftertaste. |
| C | Latakia | 6-C | Smokey-like taste, very clean phenolic aroma and taste, model had taste and aroma similar to the Latakia tobacco aroma. |
| D | Turkish | 5-C | Very light turkish-like taste and aroma, green oily note. Some smoke-like and aroma. Oily mouth coating. |

There was no noticeable sweetness like that observed in the combination flavor of Sample 8-B. The bitterness noted in the models made with Sample 8-B was therefore believed to be coming from the Burley and Flue Cured components of the blend, and the oily mouth feel from the Turkish component.

EXAMPLE 10

A blended flavor (Sample 10-B) was made using one sample from each of the Example 4-7 extractions as follows:

| Tobacco | Sample No. | Amount |
|---|---|---|
| Latakia | 6-4 | 1.00 g |
| Turkish | 5-3 | 1.00 g |
| Burley | 7-3 | 1.00 g |
| Flue Cured | 4-1 | 1.00 g |

EXAMPLE 11

Another blended flavor (Sample 11-B) was made using the following:

| Tobacco | Sample No. | Amount |
|---|---|---|
| Flue Cured | 4-C | 1.00 g |
| Turkish | 5-C | 1.00 g |
| Latakia | 6-C | 1.00 g |
| Burley | 7-C | 1.00 g |
| Nicotine | | 0.600 g |
| Malic Acid | | 0.200 g |

Blended flavor Sample 11-B was evaluated in a model as described in Example 8. Evaluation of the model yielded a flavor that had sweetness, bitterness, smoke-like flavor, mouthfeel, harshness and body, and slight Burley characteristics. The flavor was considered not good, but not bad. The Latakia and Burley flavors could be detected in the flavor mixture, however very little of the Flue Cured or Turkish-like flavors were noticed in the blended flavor.

EXAMPLE 12

Several models made from the combination flavors of Samples 4-C, 5-C, 6-C and 7-C were evaluated in various configurations, with each sample applied to a different segment, such as segments 174–180 in FIGS. 2 and 3. The flavors from Samples 10-B and 11-B did not yield the clean notes that were noted with configurations using separate combination flavors on each segment. The configuration using separate combination flavors did a much better job of flavor delivery with a greatly reduced flavor amount per model.

Since flavor delivery was improved using small (7 mm–10 mm) substrates, this required much less flavor per model. Each flavor collected from the distilled tobacco made several models. Only 10 mg of flavor material is required using a 10 mm substrate, instead of a 100 mg when a whole sheet is used. In most cases, the flavor sample collected was in 20.0 g of propylene glycol, or eluted with 5.7 g of propylene glycol from the Cambridge filter pads. Even this 5–7 gram sample will then yield 500–700 models from 45 grams of tobacco. Using flavor substances from the four tobaccos extracted in Examples 4–7—Burley, Turkish, Latakia and Flue Cured—would yield 500–700 cigarettes just from the Cambridge filter flavor samples from 180 g of tobacco. These flavor substances are only about $\frac{1}{8}$ of the total flavor substances collected in these Examples.

EXAMPLE 13

With the above discussion in mind, the best flavor substances from the Samples collected were picked. The selection was made by comparing the aroma of all flavor substances collected, i.e. the best Burley Sample, Flue Cured Sample, Turkish Sample and Latakia Sample. The results were as follows:

| Tobacco | Sample No. |
|---|---|
| Burley | 2-2 |
| Latakia | 6-3 |
| Turkish | 5-3 |
| Flue Cured | 4-1 |

Several single substrate sheets were streaked at 100 mg/single sheet and cut to 10 mm tube segments. This resulted in 10 mg flavor per segment, with 10 segments for each of the four flavors.

Samples of the 10 mm tubes made from the Burley, Flue Cured, Turkish and Latakia flavor substances were made into models. Combination models of these flavors were also evaluated with and without nicotine. In the nicotine containing models, a 7 mm segment containing 2.5 mg of nicotine was used. Evaluations and observations were made by smoking the models.

Smoking Observations

1. When smoked separately, the Latakia and Burley gave the most flavor. Latakia had a smokey, phenol-like taste. Latakia tasted like it smells. Burley had a dusty, earthy ammoniacal taste. Flue Cured and Turkish had somewhat similar tastes—tobacco-like; with the Flue Cured having sweeter hay-like notes. Both of these were not as heavy as Burley and Latakia.
2. Burley and Flue Cured gave a somewhat bitter taste and better after taste and more mouth coating than Latakia and Turkish.
3. Turkish did not impart a good Turkish-like flavor as compared to Turkish in a tobacco blend.
4. Burley, Flue Cured and Turkish blended well with nicotine; Latakia and nicotine yielded a harshness that changed with the level of nicotine delivered, i.e. more nicotine, more harshness. Flue Cured and Turkish had a very slight effect of this type. Burley with nicotine was very smooth.
5. Single flavor models were unbalanced and did not smoke as well as the combination models.
6. Combination models with 10 mm tubes of each flavor were overbalanced with Latakia and Burley in that order. Reduced tube length or reduced flavor levels on tubes for Flue Cured and Turkish may give better results.
7. Removal of Turkish or Flue Cured segments from the model made an almost unnoticeable change. Removing Burley or Latakia segments made a big change.
8. Addition of nicotine made a definite difference in taste as well as mouth feel, harshness, body.
9. These models had more actual taste than cigarettes.
10. A definite sweetness was noted in fresh made tubes that moderated over time, probably due to the propylene glycol. Flue Cured imparted a sweetness and a bitterness in the aerosol.
11. The harshness effect imparted by Latakia and nicotine was more pronounced in a level of nicotine above 1.0 mg per model and was reduced in models containing 0.5–0.6 mg nicotine.

EXAMPLE 14

Three models were made up with seven segments as shown in FIGS. 2 and 3. In each case, the selection of the preferred flavor to be used was based on the aroma of the samples at the time of selection. The flavors were used at a level of 10 mg of a flavor sample on a 10 mm segment. The combination tobacco flavors used in Models 14-1 and 14-2 comprised a combination of six typical flavors used as cigarette top dressings, applied at a level of 10 mg of the combination flavors on a 10 mm segment. The nicotine segments in Models 14-1 and 14-3 used 2.5 mg nicotine on a 7 mm segment. The menthol in Model 14-3 was used at a level of 1.43 mg on a 10 mm segment. The specific flavors used on the separate segments and the order of the segments were as follows:

| Segment No. | Flavor |
|---|---|
| | Model 14-1 |
| 174 | Sample 2-2 (Burley) |
| 175 | Sample 6-1 (Latakia) |
| 176 | Nicotine |
| 177 | Sample 2-2 (Burley) |
| 178 | Sample 6-1 (Latakia) |
| 179 | Sample 5-3 (Turkish) |
| 180 | Combination of tobacco flavors |
| | Model 14-2 |
| 174 | Sample 2-2 (Burley) |
| 175 | Sample 6-1 (Latakia) |
| 176 | Sample 2-2 (Burley) |
| 177 | Sample 6-1 (Latakia) |
| 178 | Sample 5-3 (Turkish) |
| 179 | Sample 4-1 (Flue Cured) |
| 180 | Combination of tobacco flavors |
| | Model 14-3 |
| 174 | Sample 2-2 (Burley) |
| 175 | Sample 6-1 (Latakia) |
| 176 | Nicotine |
| 177 | Sample 2-2 (Burley) |
| 178 | Sample 6-1 (Latakia) |
| 179 | Sample 5-3 (Turkish) |
| 180 | Menthol |

Model 14-3 was preferred.

The flavor substances of the present invention have been found to be particularly well suited for smoking articles that use a heat source which heats the portion of the smoking article to which the flavor substances have been applied to a relatively low temperature, such as between about 80° C. and about 200° C. Even at these low temperatures, the separately applied flavor substances have released without interfering with the release of the other flavor substances, producing a good smoke taste.

It should be appreciated that the structures and methods of the present invention are capable of being incorporated in the form of a variety of embodiments, only a few of which have been illustrated and described above. For example, the heating between stages could be carried out as one continuous temperature rise with collection flasks changed after the first desired temperature has been reached. The invention may be embodied in other forms without departing from its spirit or essential characteristics. Thus, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. A process for producing flavor substances from tobacco comprising:

(a) heating tobacco during a first staged heating to a first toasting temperature to drive off volatile materials;

(b) increasing said toasting temperature during a second staged heating to a second toasting temperature; and (c) separately collecting, as flavor substances, at least portions of said volatile materials driven off at said first and second toasting temperatures.

2. The process of claim 1 wherein the first and second toasting temperatures differ by at least about 50° C.

3. The process of claim 1 wherein the heating is carried out at or near atmospheric pressure and the flavor substances are collected at a first toasting temperature of between about 100° C. and about 225° C. and at a second toasting temperature of between about 225° C. and about 350° C.

4. The process of claim 3 wherein the first toasting temperature is between about 200° C. and about 216° C. and the second toasting temperature is between about 270° C. and about 325° C.

5. The process of claim 1 wherein a first collection occurs while the tobacco is held at a first toasting temperature and a second collection occurs while the tobacco is heated to and held at a second toasting temperature, said first and second toasting temperatures differing by at least 50° C.

6. The process of claim 1 wherein the heating is carried out in an inert atmosphere.

7. The process of claim 1 wherein the heating is carried out so that none of the tobacco reaches a temperature of more than about 20° C. above the first toasting temperature during the first staged heating and about 20° C. above the second toasting temperature during the second staged heating.

8. The process of claim 1 wherein the heating is carried out slowly so that the highest temperature of any of the tobacco being heated is not more than about 20° C. above the lowest temperature of any of the tobacco being heated.

9. A process for producing a flavor substance from tobacco comprising:

(a) reducing the moisture content of the tobacco to less than about 4% moisture without removing volatile flavor components; p1 (b) heating the dried tobacco at a toasting temperature to drive off volatile materials; and (c) collecting, as a flavor substance, at least a portion of the volatile materials.

10. The process of claim 9 wherein the moisture content of the tobacco is reduced by freeze drying.

11. The process of claim 9 wherein the moisture content is reduced using a desiccant.

12. The process of claim 10 wherein the freeze drying process is carried out at a pressure below about 100 millitorr and a temperature less than about 0° C.

13. The process of claim 10 wherein the freeze drying is carried out at a pressure below about 10 millitorr and a temperature less than about −5° C., and wherein the freeze drying reduces the moisture content of the tobacco to less than 1%.

14. The process of claim 9 wherein the heating is carried out in an inert atmosphere.

15. A process for producing flavor substances from tobacco comprising:

(a) heating tobacco in a flowing gas stream at a toasting temperature to drive off volatile materials; and (b) separately collecting, as flavor substances, a portion of the volatile materials that are removed from said flowing gas stream as it passes sequentially through (i) a moderate temperature trap;

(ii) a cold temperature trap; and (iii) a filter capable of collecting all submicron sized aerosol particles from the flowing gas stream.

16. The process of claim 15 wherein the moderate temperature trap comprises a liquid sorbent through which the gas stream passes.

17. The process of claim 16 wherein the liquid sorbent comprises propylene glycol.

18. The process of claim 15 wherein the moderate temperature trap is operated at or near atmospheric pressure and cools the gas stream to a temperature below about 50° C.

19. The process of claim 18 wherein the gas stream is cooled to a temperature of between about 20° C. and about 40° C. in the moderate temperature trap.

20. The process of claim 15 wherein the cold temperature trap comprises a liquid sorbent through which the gas stream passes.

21. The process of claim 20 wherein the liquid sorbent comprises propylene glycol.

22. The process of claim 15 wherein the cold temperature trap is operated at or near atmospheric pressure and cools the gas stream to a temperature below about 10° C.

23. The process of claim 22 wherein the cold temperature trap cools the gas stream to a temperature of between about 5° C. and about 0° C.

24. The process of claim 22 wherein the cold temperature trap is operated at about 0° C.

25. The process of claim 15 wherein the filter is operated at or near atmospheric pressure and at a temperature below about 40° C.

26. The process of claim 15 wherein the gas stream is an inert gas stream.

27. A smoking article comprising flavor substances made by the process of claim 1 wherein the separately collected flavor substances are applied to separate portions of the smoking article such that release of one or more of the separately collected flavor substances from the smoking article during smoking does not interfere with the release of other applied flavor substances.

28. The smoking article of claim 27 further comprising a filter and wherein at least a portion of the filter constitutes one of said separate portions.

29. The smoking article of claim 27 wherein the smoking article further comprises a heat source adapted to heat the portions of the smoking article to which the flavor substances have been applied to temperatures of between about 80° C. and about 200° C.

30. The smoking article of claim 29 wherein the heat source is selected from the group consisting of electrical heat sources, electrochemical heat sources, chemical heat sources and combustion heat sources.

31. A smoking article comprising the separately collected tobacco flavor substances of claim 1 wherein the separately collected flavor substances are applied to a plurality of individual segments of a carrier within the smoking article.

32. The smoking article of claim 31 wherein a plurality of individual segments comprises at least three segments.

33. The smoking article of claim 31 wherein the carrier comprises two or more segments of rolled tobacco sheet and different tobacco flavor extracts are applied to at least two of such segments.

34. The smoking article of claim 31 wherein the smoking article further comprises a heat source adapted to heat the segments of the carrier to which the flavor substances have been applied to temperatures of between about 80° C. and about 200° C.

35. The smoking article of claim 31 wherein the heat source is selected from the group consisting of electrical heat sources, electrochemical heat sources, chemical heat sources and combustion heat sources.

* * * * *

UNITED STATES PATENT AND TRADEMARK OFFICE

CERTIFICATE OF CORRECTION

PATENT NO. :5,235,992

DATED :August 17, 1993

INVENTOR(S) :Andrew J. Sensabaugh, Jr.

It is certified that error appears in the above-indentified patent and that said Letters Patent is hereby corrected as shown below:

Col. 7, line 27, "2.2" should be --2-2--.

Col. 7, line 47, insert --EXAMPLE 5--.

Col. 7, line 64, "-3.5" should be --~3.5--.

Col. 8, line 12, "-3.5" should be --~3.5--.

Col. 8, line 49, "6.5" should be --6-5--.

Col. 9, line 3, "7.2" should be --7-2--.

Col. 9, line 3, "7.4" should be --7-4--.

Col. 9, line 4, "7.3" should be --7-3--.

Col. 11, line 55, "16B" should be --168--.

Col. 12, line 21, "two" should be --tow--.

Col. 16. line 46, delete "pl".

Signed and Sealed this

Fifteenth Day of March, 1994

*Attest:*

*Attesting Officer*

BRUCE LEHMAN

*Commissioner of Patents and Trademarks*